US007825893B2

(12) United States Patent
Oka et al.

(10) Patent No.: US 7,825,893 B2
(45) Date of Patent: Nov. 2, 2010

(54) LIQUID CRYSTAL DISPLAY, AS WELL AS, A BACKLIGHT CONTROLLER AND A METHOD FOR THE SAME

(75) Inventors: Naoya Oka, Yokohama (JP); Yoshiyuki Nagashima, Yokohama (JP)

(73) Assignee: Hitachi, Ltd., Tokyo (JP)

( * ) Notice: Subject to any disclaimer, the term of this patent is extended or adjusted under 35 U.S.C. 154(b) by 722 days.

(21) Appl. No.: 11/748,097

(22) Filed: May 14, 2007

(65) Prior Publication Data

US 2008/0117160 A1 May 22, 2008

(30) Foreign Application Priority Data

Nov. 20, 2006 (JP) ..... 2006-312958

(51) Int. Cl.
*G09G 3/36* (2006.01)

(52) U.S. Cl. ..... 345/102; 345/690

(58) Field of Classification Search ..... 345/102, 345/207, 87, 89, 204, 690; 353/97
See application file for complete search history.

(56) References Cited

U.S. PATENT DOCUMENTS

| | | | | |
|---|---|---|---|---|
| 7,053,881 | B2 * | 5/2006 | Itoh | 345/102 |
| 7,093,941 | B2 * | 8/2006 | Kawashima et al. | 353/97 |
| 7,639,220 | B2 * | 12/2009 | Yoshida et al. | 345/87 |
| 2005/0057486 | A1 * | 3/2005 | Aoki et al. | 345/102 |
| 2005/0104841 | A1 * | 5/2005 | Sohn et al. | 345/102 |

FOREIGN PATENT DOCUMENTS

| | | |
|---|---|---|
| JP | 08-201812 | 8/1996 |
| JP | 2003-36063 | 2/2003 |
| JP | 2005-308792 | 11/2005 |

OTHER PUBLICATIONS

English Translation of JP 2005-308792.*

* cited by examiner

*Primary Examiner*—Amare Mengistu
*Assistant Examiner*—Hong Zhou
(74) *Attorney, Agent, or Firm*—Antonelli, Terry, Stout & Kraus, LLP.

(57) ABSTRACT

A liquid crystal display, comprising: a liquid crystal display portion for inputting a video signal to display an image thereon; a backlight provided on a rear side of the liquid crystal display portion, for illuminating the liquid crystal display portion from a rear surface thereof; a backlight driver portion for driving the backlight, also having a light control function for controlling a light intensity of the illuminating lights from that backlight; a feature detector portion for detecting an averaged brightness of the video signal, and also a histogram of brightness or a color, upon basis of said video signal inputted; and a light intensity control portion for controlling the light intensity of the illuminating lights from the backlight, through the light control function of the backlight driver portion, upon basis of the histogram of brightness or color, as well as, the averaged brightness of the video signal detected by the feature detector portion.

10 Claims, 7 Drawing Sheets

| CONTROL MATRIX | | APL | | |
|---|---|---|---|---|
| | | LowAPL | MidAPL | HighAPL |
| HIGH-BRIGHTNESS DEGREE (HST) | Low_HST | A1 | A2 | A3 |
| | Mid_HST | B1 | B2 | B3 |
| | High_HST | C1 | C2 | C3 |

LIQUID CRYSTAL DISPLAY, AS WELL AS, A BACKLIGHT CONTROLLER AND A METHOD FOR THE SAME

BACKGROUND OF THE INVENTION (1) Field of the Invention

The present invention relates to a liquid crystal display and a backlight controller (i.e., a dimmer) thereof, and it relates, in particular, to a liquid crystal display and a backlight controller thereof, for enabling to adjust or control brightness of the backlight, depending upon the characteristics or features of an image to be displayed on that display.

(2) Description of the Related Arts

In recent years, because of the thin thickness thereof, the liquid crystal display is widely adopted, as a flat-type display device for displaying an image thereon, such as, for use in a television receiver, or a display device for a computer, as well as, a plasma display panel (PDP).

In particular, within the liquid crystal display for use of displaying the image on a screen, which is made of a liquid crystal display panel, there is provided a backlight for illuminating or lighting up that liquid crystal display from the rear surface thereof. And, normally, an operator adjusts or controls brightness of this backlight, by adjusting or controlling a controller device for the backlight, variably, and thereby obtaining a clear or easy screen to see.

However, in such the case, as is disclosed in Japanese Patent Laying-Open No. Hei 8-201812 (1996), for maintaining the brightness of display and also the contract of the liquid crystal display device to be almost constant, irrespective of changes of the an averaged level of video signals and the temperature of the backlight, it is already known to detect the averaged level of video signals by an APL detector circuit, wherein the brightness of the backlight is decreased if the averaged level of video signals by the APL detector circuit is high, while the brightness of the backlight is increased if the averaged level of video signals by the APL detector circuit is low.

Also, for determining the brightness of liquid crystal panel to be most suitable or appropriate for a screen to be seen, for example, in Japanese Patent Laying-Open No. 2005-308792 (2005), it is also already known to calculate out an averaged value "Ave" of brightness from the video signals obtained during a predetermined time-period, with an aid of a microcomputer, and thereby reducing the brightness of illumination of the backlight when the averaged value of that brightness exceeds or higher than a predetermine threshold value, while increasing the brightness of illumination of the backlight when the averaged value of that brightness is lower than that predetermine threshold value.

BRIEF SUMMARY OF THE INVENTION

Within the conventional arts mentioned above, control is achieved or conducted upon the brightness of the backlight, with using APL (Averaged Picture Level) therein, which is detectable from the video signals to be displayed; i.e., lowering it down when this APL is high, or on the contrary thereto, increasing it when the APL is low. However, with such conventional arts, since the control is conducted upon the backlight with using only the APL, i.e., the averaged brightness of the video signals, it is impossible to control the backlight at the most suitable or appropriate illuminating brightness thereof, in particular, for the images or pictures, which differ from each other in the characteristics or features thereof, even if they have the same APL.

An object, according to the present invention, is therefore to provide a backlight controller and a method, for enabling the control upon the illuminating brightness of the backlight, most suitably, even when displaying such the images thereon, differing from each other in the features or characteristics thereof, including those having the same APL, and further to provide a liquid crystal display for enabling the most suitable or appropriate images thereon, with applying those therein.

According to the present invention, for accomplishing the object mentioned above, there is provided a liquid crystal display, comprising: a liquid crystal display portion, which is configured to input a video signal to display an image thereon; a backlight, which is provided on a rear side of said liquid crystal display portion, and is configured to illuminates said liquid crystal display portion from a rear surface thereof; a backlight driver portion, which is configured to drive said backlight and also to have a light control function for controlling a light intensity of the illuminating lights from said backlight; a feature detector portion, which is configured to detect an averaged brightness of said video signal and also a histogram of brightness or a color, upon basis of said video signal inputted; and a light intensity control portion, which is configured to control the light intensity of the illuminating lights from said backlight, through the light control function of said backlight driver portion, upon basis of said histogram of brightness or color and also said averaged brightness of said video signal detected by said feature detector portion.

Further, according to the present invention, within the liquid crystal display as described in above, it is preferable that said light intensity control portion controls the light intensity of the illuminating lights from said backlight, upon basis of pattern said histogram of brightness or color and also said averaged brightness of said video signal detected by said feature detector portion. And, further it is preferable that said light intensity control portion includes a memory portion, which is configured to memorized the light intensity of the illuminating lights from said backlight, which is determined in advance, upon basis of the pattern said histogram of brightness or color and also said averaged brightness of said video signal detected by said feature detector portion.

Also, according to the present invention, also for accomplishing the object mentioned above, there is provided a backlight controller for controlling an intensity of illumination lights from a backlight for illuminating a liquid crystal display portion from a rear surface thereof, comprising: a backlight driver portion, which is configured to drive said backlight and also to have a light control function for controlling a light intensity of the illuminating lights from said backlight; a feature detector portion, which is configured to detect an averaged brightness of said video signal and also a histogram of brightness or a color, upon basis of said video signal inputted; and a light intensity control portion, which is configured to control the light intensity of the illuminating lights from said backlight, through the light control function of said backlight driver portion, upon basis of said histogram of brightness or color and also said averaged brightness of said video signal detected by said feature detector portion.

Further, according to the present invention, within the backlight controller as described in above, it is preferable that said light intensity control portion controls the light intensity of the illuminating lights from said backlight, upon basis of pattern said histogram of brightness or color and also said averaged brightness of said video signal detected by said feature detector portion. And, further, it is preferable that said light intensity control portion includes a memory portion, which is configured to memorized the light intensity of the illuminating lights from said backlight, which is determined in advance, upon basis of the pattern said histogram of brightness or color and also said averaged brightness of said video signal detected by said feature detector portion.

In addition to the above, according to the present invention, also for accomplishing the object mentioned above, there is also provided a backlight controlling method for controlling an intensity of backlight illumination lights for illuminating a liquid crystal display portion, inputting a video signal and displaying an image thereon, from a rear surface thereof, comprising the following steps of: detecting an averaged brightness of said video signal, and also a histogram of brightness or a color, upon basis of said video signal inputted; and controlling the light intensity of the illuminating lights from said backlight, upon basis of said histogram of brightness or color and also said averaged brightness of said video signal detected.

And, according to the present invention, within the backlight controlling method as described in the above, it is preferable that the light intensity of the illuminating lights from said backlight is controlled, upon basis of pattern said histogram of brightness or color and also said averaged brightness of said video signal detected by said feature detector portion. And further, it is preferable that the light intensity of the illuminating lights from said backlight is determined, in advance, to be memorized, upon basis of the pattern said histogram of brightness or color and also said averaged brightness of said video signal detected by said feature detector portion.

Thus, according to the present invention mentioned above, with using the averaged brightness of the video signal, i.e., APL, and also detection result of histogram, as well, it is possible to obtain a backlight controller and the method thereof, for controlling the backlight, most suitable or appropriate the features of the image to be displayed, and further with utilizing this, it is possible to obtain an effect of providing a liquid crystal display enabling to display an image thereon, most suitable or appropriate to the features thereof, being also superior practically.

BRIEF DESCRIPTION OF THE DRAWINGS

Those and other objects, features and advantages of the present invention will become more readily apparent from the following detailed description when taken in conjunction with the accompanying drawings wherein.

DETAILED DESCRIPTION OF THE EMBODIMENTS

Hereinafter, embodiments according to the present invention will be fully explained by referring to the attached drawings.

Figure 1:
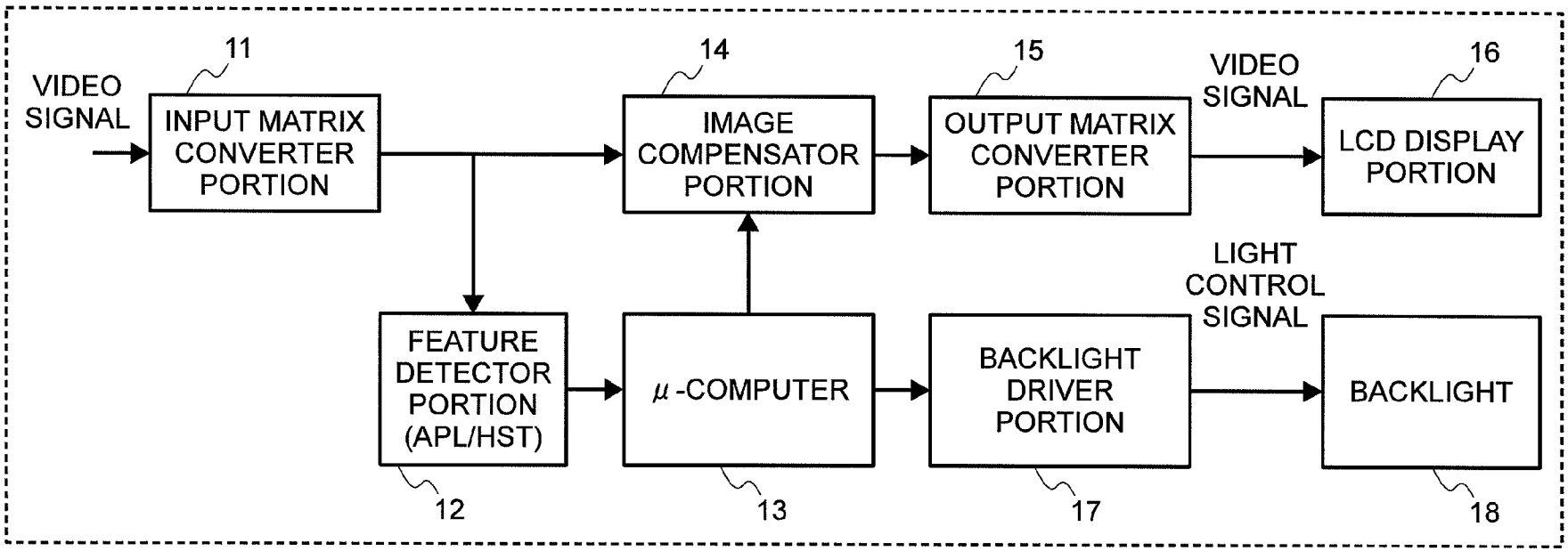
FIG. 1 is a block diagram for showing an outline structure of an image processing apparatus, according to the present invention.

First of all, FIG. 1 attached herewith is a block diagram for showing the outlook structure of an image processing apparatus, according to one embodiment of the present invention, and in particular, it shows the outline structure the image processing apparatus within a liquid crystal display device, adopting a liquid crystal display as a display portion thereof. In the figure, an image or video signal to be inputted into the apparatus, after being received through an antenna, etc., of a broadcast receiver apparatus, and being selected by a tuner thereof, is converted into a brightness signal Y and chromic signals Cb and Cr within an input matrix converter portion 11. However, this video signal inputted should not be restricted to that received by the broadcast receiver apparatus mentioned above, but it may be in any kind of signal format other than that, including such as, RGB signals or video signals (Y, Pb, Pr/Y, Cb, Cr), as being the video signals from a personal computer, for example.

Next a feature detector portion 12, inputting the brightness signal Y and chromic signals Cb and Cr, which are converted within the input matrix converter portion 11, detects APL (an averaged brightness: Averaged Picture Level), and further a brightness/color histogram. The information relating to the APL and brightness/color histogram, which are detected in this feature detector portion 12, is inputted into a microcomputer 13 (hereinafter, being mentioned by only "μ-computer"), which builds up the controller portion of the image processing apparatus, as a whole.

In this μ-computer 13, starting up software stored in advance within a built-in memory device, for example, analysis is made on the features or characteristics in distribution of each of histograms, upon information relating to the APL and brightness/color histograms, which are inputted as was mentioned, and it produces an image control signal upon basis of the analyzing results thereof, and outputs the image control signal produced to an image or video compensator portion 14.

Within the video compensator portion 14 inputting the image control signal from the μ-computer 13 mentioned above, with using that image control signal is conducted picture quality processing upon the brightness signal Y and the chromic signals Cb and Cr from the above-mentioned input matrix converter portion 11, i.e., depending upon the features or characteristics of the image analyzed, and thereby outputting it to an output matrix converter portion 15. In this output matrix converter portion 15, converting the brightness signal Y and the chromic signals Cb and Cr mentioned above fitting to an image display portion, to provide an output, in particular, a liquid crystal display (LCD) 16, an improvement is achieved on contrast depending upon the features of the input video signal to be displayed on that image display portion, and thereby it is possible to display a bright or vivid color image, which is improved in the sense of contrast to a viewer.

On the other hand, a backlight driver portion 17 changes voltage or current to be supplied to a backlight 18, which is disposed on a rear surface of the LCD display portion 16 to illuminate that display portion from the rear surface thereof, upon basis of the voltage level of a dim or light control signal produced upon a principle, details of which will be mentioned below, and thereby change the light control (i.e., illumination) of that backlight. However, due to the reasons, such as, luminous efficiency, etc., for example, as this backlight 18 is mainly applied a fluorescent lighting, i.e., generating visible lights through excitation of the a fluorescent substance (a phosphor) painted on a tube wall by ultraviolet light rays from a mercury, which are generated accompanying with discharges, and therefore, it is possible to control luminous intensity (i.e., quantity of light emission) thereof by changing a duty ratio of a drive pulse signal to be applied thereto. Then, in the dim or light control mentioned above, a control signal for use of controlling the backlight from the μ-computer 13 is outputted to the backlight driver portion 17, and in this backlight driver portion 17, the duty ratio of the drive pulse signal is changed depending on the control signal transmitted from that μ-computer; thereby controlling the luminous intensity of the backlight.

Following to the above, detailed explanation will be made hereinafter on the principle of the control method for light or dim control of the backlight, in the image processing apparatus, the detailed structure of which was given above.

Figure 2A:
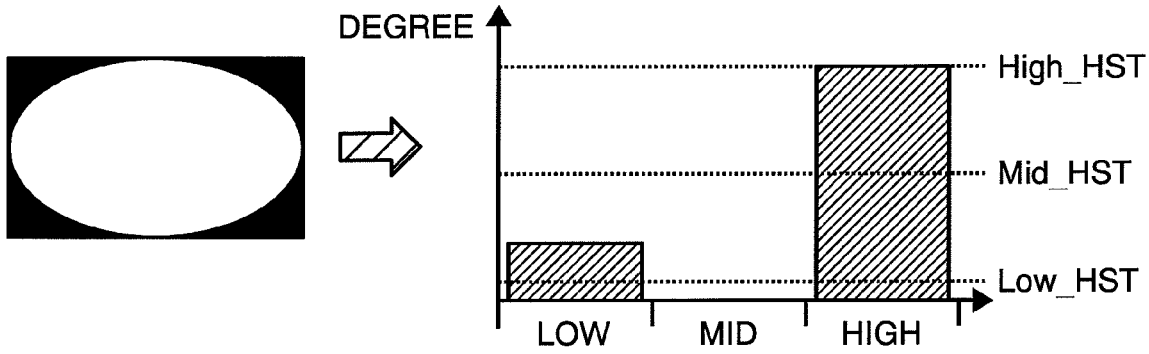
FIGS. 2(A) and 2(B) are graphs for showing images and histograms detected from those.
Figure 2B:
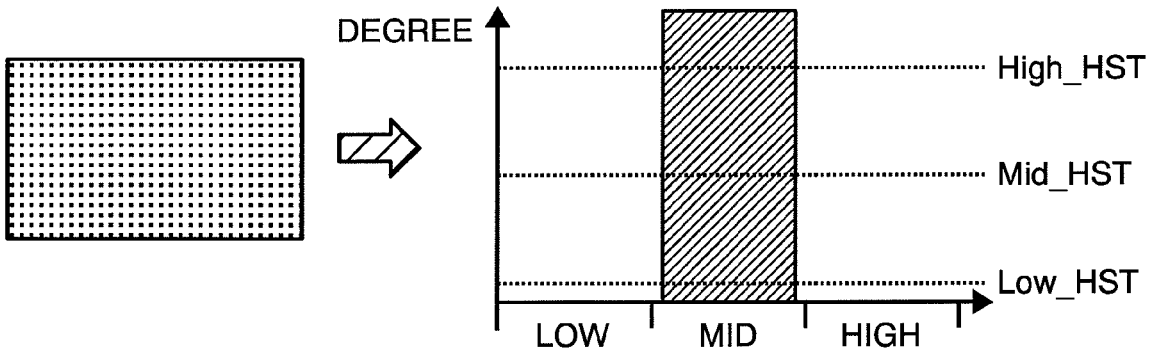

FIGS. 2(A) and 2(B) attached herewith show images, though being same in APL, i.e., the averaged brightness, which is obtained in the feature detector portion 12 mentioned above, but differing from each other in the features or characteristics thereof. Thus, FIG. 2(A) shows therein a screen, although the central portion of the image is bright, but the surrounding thereof is dark, on the other hand, FIG. 2(B) shows a screen displaying an image, having almost same brightness as a whole. In such case, although the images displayed thereon are different from each other in the features or characteristics thereof, however APL (the averaged brightness) are same to each other, which can be obtained from the images as the wholes.

Then, with the dim or light controlling method according to the present embodiment, by conducting the backlight control with using the APL mentioned above, and further a brightness histogram, as well, it is possible to achieve the brightness of the backlight responding to the features or characteristics of the image. However, in FIGS. 2(A) and 2(B) mentioned above, while indicating the brightness on the horizontal axes, there are shown degrees, which can be obtained at each of the stages classified into three (3) stages, i.e., low brightness (LOW), middle brightness (MID), and high brightness (HIGH).

As is apparent from FIGS. 2(A) and 2(B) mentioned above, although those are images being same to each other in the APL, however, they are completely different from each other in results of detecting the brightness histograms thereof. Thus, the image shown in FIG. 2(A) has a large image portion of high brightness, and for this reason, it comes to be an image having high degree of histogram on the high brightness side. However, in this case, if the brightness of the backlight 18 is high, it is glaring for a viewer, and then a possibility can be considered that it gives discomfort glare or feeling. Then, in such case, for example, by lowering down the backlight brightness, it is possible to determine the most suitable brightness responding to the image.

On the other hand, in FIG. 2(B), it is an image having a middle class of brightness as the entire thereof, and in this case, completely different from that shown in FIG. 2(A), it is a image having a low degree (or no degree) of histogram on the high brightness side. However, in such the case, it may be preferable not to lower the brightness of the backlight 18, since the image that can be obtained is dark as a whole, if lowering down the brightness of the backlight 18.

Further, in FIGS. 2(A) and 2(B) mentioned above are shown the cases of classifying areas for detection the brightness histograms into the three (3) regions, i.e., low brightness (LOW), middle brightness (MID), and high brightness (HIGH). However, the present invention should not be restricted to this, but it can be set up, arbitrarily, at a number of stages larger than that, such as, eight (8) stages, sixteen (16) stages, stages having a further larger number, for example.

Also, in the cases of FIGS. 2(A) and 2(B) mentioned above, "Low_HST", "Mid_HST" and "High_HST" indicate the threshold values, each of which is set up for degrees of the brightness histogram, to determine the features or characteristics of an image upon the fact, i.e., the degree of brightness at each stage is higher (exceeding) or lower than which one of those threshold values. Thus, the brightness of the image is controlled depending on the fact it is higher or lower than this threshold value Next, FIG. 3 attached herewith shows an example of expressing the features or characteristics of the image, which can be detected through the method mentioned above, in the form of a matrix. In this matrix, the horizontal direction indicates the APL, i.e., the averaged brightness obtained within the feature detector portion 12, being classified into three (3) stages, low averaged brightness (Low APL), middle averaged brightness (Mid APL), and high averaged brightness (High APL), while the vertical direction indicates the high brightness degree (HST), i.e., degree of the histogram in a high brightness (HIGH) region, for example, by the threshold values, "Low_HST", "Mid_HST" and "High_HST" mentioned above. And, "A1" through "A3", "B1" through "B3", and "C1" through "C3" indicate control values of the backlight brightness, respectively, for each of the high brightness degrees (HST). With this, the backlight brightness is controlled upon the averaged brightness of the each image (i.e., the low averaged brightness (Low APL), the middle averaged brightness (Mid APL), and the high averaged brightness (High APL)), as well as, the fact that the high brightness degree (HST) of that image exceeds (or is higher than) which one of the thresholds (i.e., "Low_HST", "Mid_HST" and "High_HST"). Thus, the backlight brightness is controlled, respectively, depending upon the histogram degree on the high brightness side. With this, it is possible to control the backlight brightness depending on the features or characteristics of the image.

Figures 3, 4:
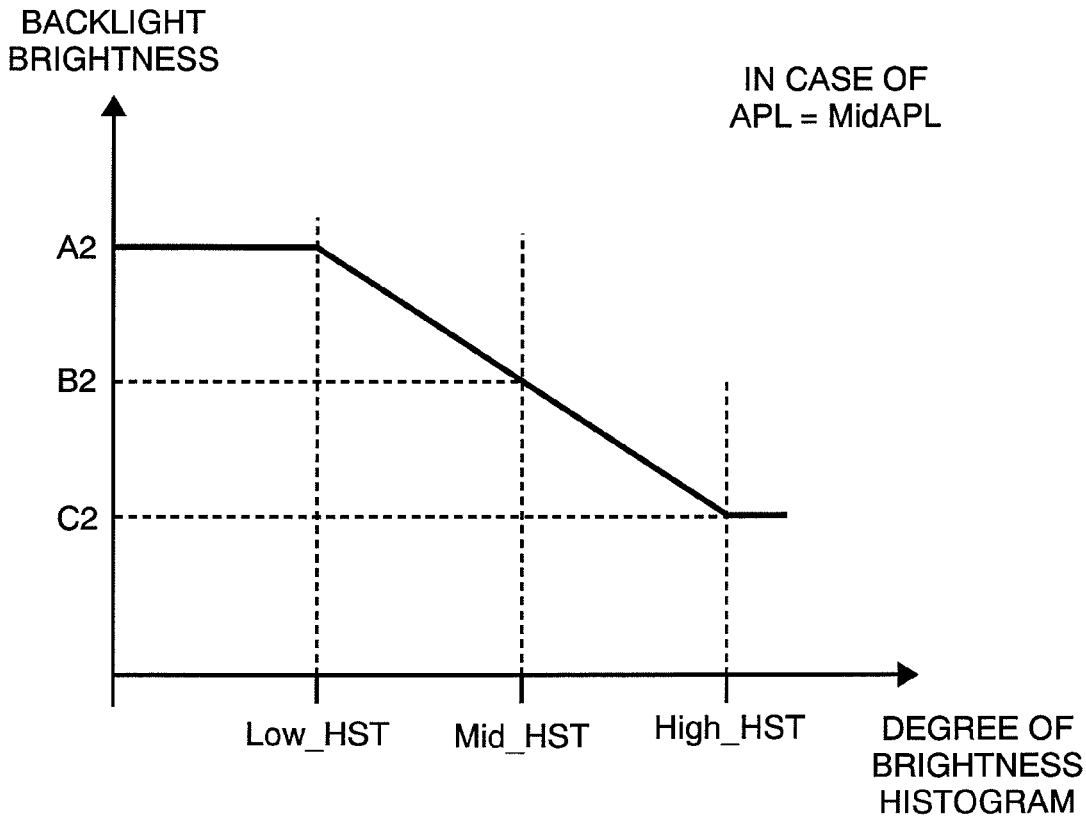
FIG. 3 is a view for showing an example of a matrix of the averaged brightness (APL) of an image detected and the brightness histogram thereof.
FIG. 4 is a graph for showing an example of relationships between degrees of brightness histogram, which are obtained by the image processing apparatus mentioned above, and the backlight brightness.

Though the features or characteristics are determined on the image to be displayed, targeting only upon the histogram degree on the high brightness side (i.e., the high brightness region (HIGH)), in particular, in the example shown in FIG. 3 motioned above; however, the present invention should not be restricted only to this, but determination of the features or characteristics may be made by targeting on the histogram degree on the middle brightness side (i.e., the middle brightness region (MID)), or the low brightness side (i.e., the low brightness region (LOW)), or alternatively, it may also be possible to control by combining them, appropriately, or using all of those three (3) regions.

Following to the above, explanation will be made in more details of determination of the control values of the backlight brightness, being set up upon basis of the features or characteristics of the image, which are detected with using the brightness histograms, as well as, the averaged brightness APL, as was mentioned above, i.e., "A1" through "A3", "B1" through "B3", and "C1" through "C3" in the matrix shown in FIG. 3 mentioned above, by referring to FIG. 4 attached herewith. However, an example shown in this FIG. 4 is in case when the averaged brightness APL=Mid APL (i.e., the middle averaged brightness), wherein the horizontal axis shows the degree of the brightness histogram (i.e., the degree of histogram in the high brightness region (HIGH)), while the vertical axis the control value, i.e., the backlight brightness.

As was already mentioned, the image having high degree of histogram on the high brightness side is glaring for the viewer and it gives the discomfort glare or feeling, if the backlight brightness is high; therefore, in this case, the control value is set at a relatively low brightness "C2". On the contrary to this, with the image being low (or nothing) in the degree of histogram on the high brightness side, the image comes to be dark as a whole when setting up the backlight brightness to below, then the control value is set up at a relatively low value of brightness "A2". Further, as is apparent from this FIG. 4, within an area or region where the degree of histogram lies around a middle, for example, the control value is set up at the value of middle brightness "B2" in proportion to the degree of diagram. In the example shown in this FIG. 4, the three (3) pieces of control values for the backlight brightness are determined A2>B2>C2, and with this, the actual backlight brightness is so controlled that the backlight brightness is lowered down as the degree of histogram rises up.

Thus, if the degree of histogram on the high brightness side is equal or lower than "Low_HST", the backlight brightness is set at "A2", at "B2" if it is about same to "Mid_HST", and "C2" if it is equal or higher than "High_HST", respectively. Also, in case when the degree of histogram on the high brightness side lies between "Low_HST" and "Mid_HST", calculation is made to obtain the backlight brightness between "A2" and "B2". Further, it is also same to the case when the degree of histogram on the high brightness side lies between "Mid_HST" and "High_HST". However, in that instance, an intermediate brightness can be set up, easily, through calculation of an interpolation or the like, in proportion to the degree of histogram, for example.

Figure 5A:
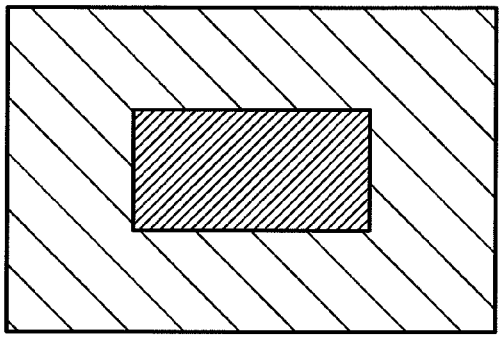
FIGS. 5(A) and 5(B) are views for showing examples of other images displayed on the display device of the image processing apparatus mentioned above.
Figure 5B:
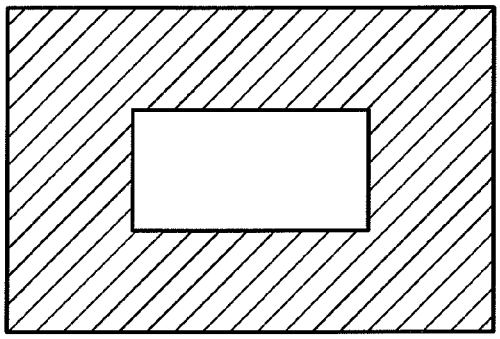

Next, FIGS. 5(A) and 5(B) attached herewith show other examples of the images. However, in those examples, both are same of APL, i.e., the averaged brightness of the image obtained within the feature detector portion 12 mentioned above, and in the case of the middle brightness (MID).

Firstly, FIG. 5(A) shows an image of being high in the degree of histogram within an area of middle gradation (i.e., the middle brightness region (MID)) and also the area of low gradation (i.e., the low brightness region (LOW)). In this instance, it is possible to increase the gradation on the black side by lowering the brightness of the backlight, and thereby achieving a so-called tightened black color. On the other hand, FIG. 5(B) shows an image of being high in the degree of histogram in the region of high gradation (i.e., the high brightness region) due to presence of a peak of white. In this case, if lowering down the backlight brightness in the similar manner to the above, the brightness of the peak of white is also lowered down, and then a contrast feeling thereof is lost. Therefore, it is preferable to make a setup of reducing a ratio of lowering the backlight brightness, or not lowering down the backlight brightness.

Then, in case of the screen shown in FIGS. 5(A) and 5(B) mentioned above, the control values "A2", "B2" and "C2" of the backlight brightness within the matrix shown in FIG. 3 mentioned above are set up, as is shown in FIG. 6 attached herewith; i.e., A2<B2=C2. With this, the degree of histogram is high within the areas or regions of the middle gradation (the middle brightness region (MID)) and the low gradation (the low brightness region (LOW)), and therefore, the control value of the backlight brightness is set at a low value "A2" in case when the degree of histogram on the high brightness side (i.e., within the high brightness region (HIGH)) is equal or lower than "Low_HST", while the control value is set at a high value "B2" or "C2" in case when it is equal or greater than "Mid_HST". Further, when the degree of histogram lies between "Low_HST" and "Mid_HST", it may be also set up, easily, for example, through the interpolation calculation or the like in proportional to the degree of histogram, similar to that mentioned above.

Figure 6:
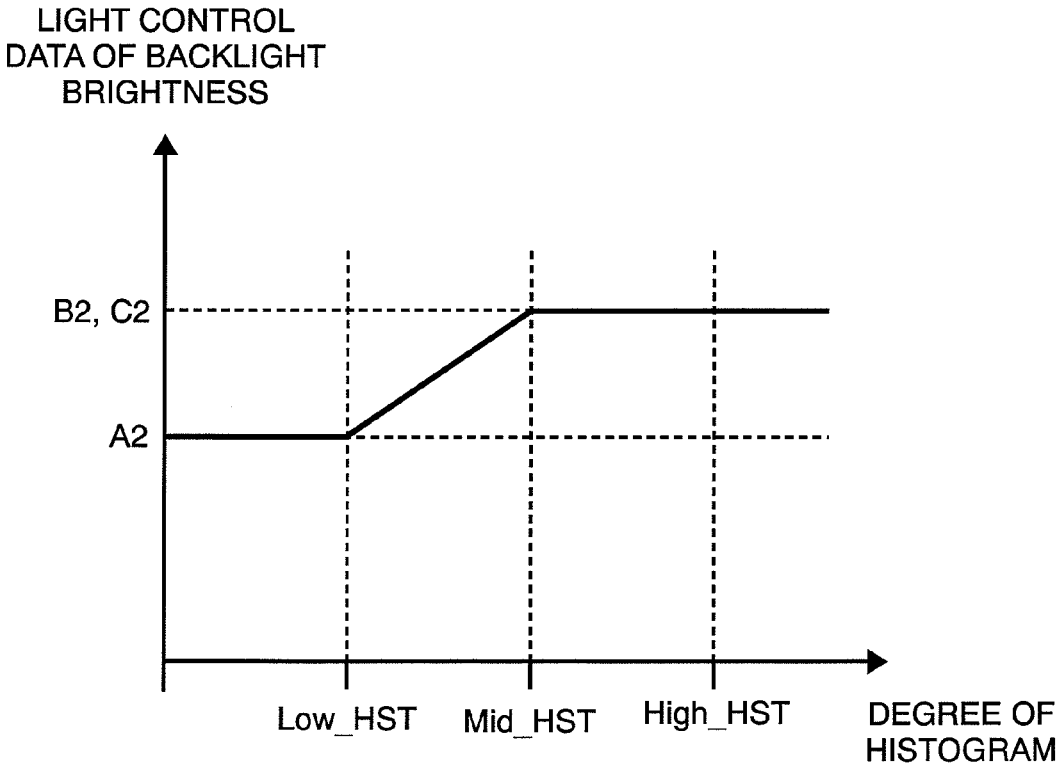
FIG. 6 is a view for showing an example of the degree of the brightness histogram and the backlight brightness suitable for the screen shown in FIGS. 5(A) and 5(B)

Though having the same averaged brightness (APL=Mid APL), the example shown in this FIG. 6 is opposite to that shown in FIG. 4 in the control characteristics of the backlight brightness, but it is possible to set up either the control characteristics shown in FIG. 4, or the control characteristics shown in FIG. 6, selectively. For example, the control characteristics shown in FIG. 4 may be set up if having priority of not giving the glare feeling to the user, in particular, of the bright portion thereof, or the control characteristics shown in FIG. 6 may be set up if having priority of suppressing the phenomenon, so-called "black float", in particular, of the dark portion thereof. Or, it is also possible to make either one of the control characteristics settable by the user through manual operation (for example, with using a menu screen). Further, not only the histogram on the high brightness side, but also by referring to the lowest one (near to the black), i.e., the lowest brightness histogram, the setup may be made to use the control characteristics shown in FIG. 6, with priority, for suppressing the "black float" phenomenon, when that the lowest brightness histogram is larger than a predetermined value, while using the control characteristics shown in FIG. 4, with priority, for suppressing the glare when it is lower than the predetermined value.

Figure 7A:
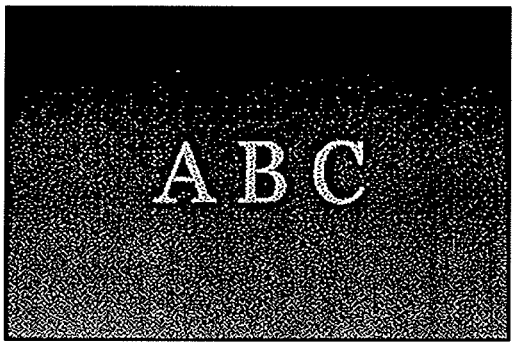
FIGS. 7(A) and 7(B) are views for showing examples of further other images displayed on the display device of the image processing apparatus mentioned above.
Figure 7B:
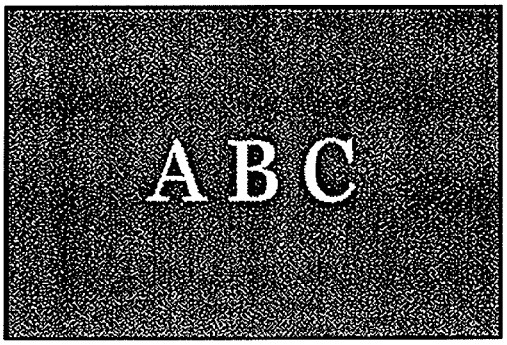

Further, FIGS. 7(A) and 7(B) attached herewith show examples of further other images. However, also in those examples, both are same of APL, i.e., the averaged brightness of the image obtained within the feature detector portion 12 mentioned above, but in the case of the low brightness (LOW).

Firstly, FIG. 7(A) shows an image of being low of APL, the averaged brightness (i.e., the low averaged brightness (Low APL)), and high in the degree of histogram within an area of low gradation (i.e., the low brightness region (LOW)). With such image, it is possible to increase the gradation on the black side, by lowering down the brightness of backlight, and thereby achieving the tightened black color. Then, in such case, it is possible to set up the brightness to be most suitable for the image, by lowering down the backlight brightness, for example.

On the other hand, FIG. 7(B) shows an image of the low averaged brightness (Low APL), but there is a peak of white therein. In this case, if lowering down the backlight brightness in the similar manner to the above, the brightness of the peak of white is also lowered down, and then a contrast feeling thereof is lost. Therefore, in case of such image, it is possible to achieve an image giving the contrast feeling, by the operation of reducing a ratio of lowering the backlight brightness, or not lowering down the backlight brightness.

Figure 8:
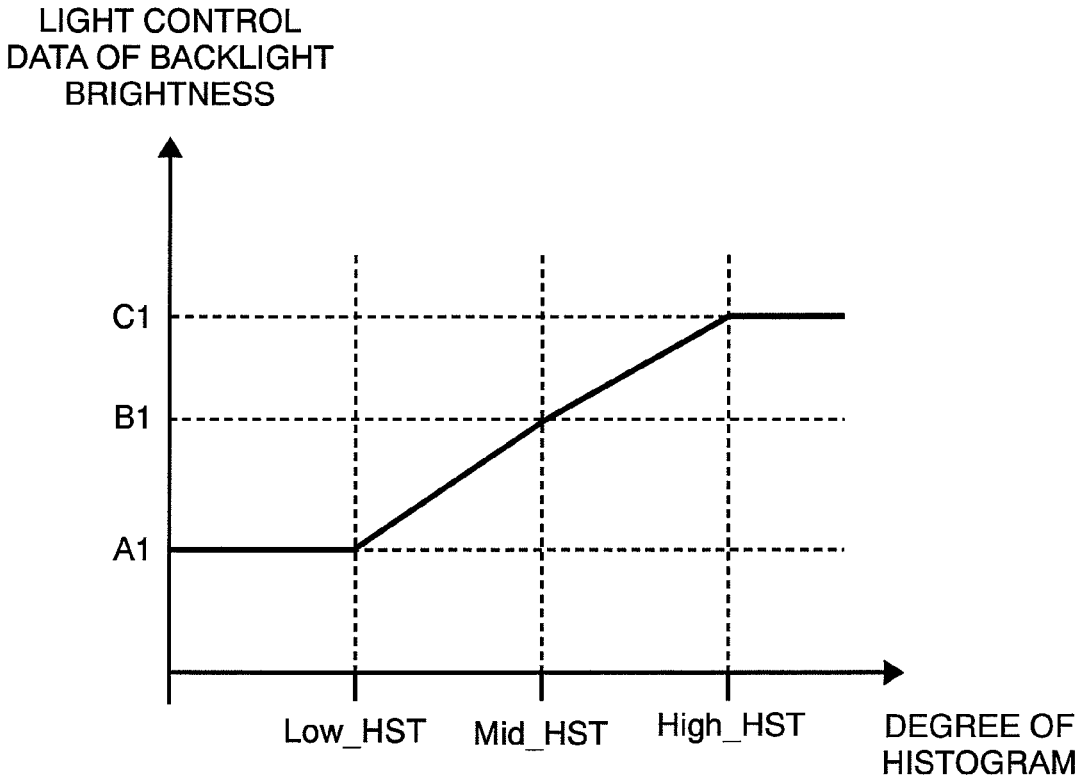
FIG. 8 is a view for showing an example of the degree of the brightness histogram and the backlight brightness suitable for the screen shown in FIGS. 7(A) and 7(B)

Then, in case of the screen shown in FIGS. 7(A) and 7(B) mentioned above, the control values "A1", "B1" and "C1" of the backlight brightness within the matrix shown in FIG. 3 mentioned above are set up, as is shown in FIG. 8 attached herewith; i.e., A1<B1<C1. With this, for an image of being high in the degree of histogram in the low brightness region (LOW), i.e., if the degree of histogram is equal or lower than "Low_HST", like the screen shown in FIG. 7(A), the setup value of the backlight is set at "A1" to reduce the brightness, and thereby achieving the tightened black color by increasing the gradation on the black side.

On the other hand, for an image having the peak value of the white therein, as shown in FIG. 7(B), i.e., if the degree of histogram is equal or higher than "High_HST", then an image giving the contrast feeling can be achieved, without reducing the backlight brightness, i.e., by setting the setup value at "C1". Also, if the degree of histogram is about same to "Mid_HST", then the setup value is set at "B1" between them. Further, when the degree of histogram lies between "Low_HST" and "Mid_HST", or between "Mid_HST" and "High_HST", it may be also set up, easily, for example, through the interpolation calculation or the like in proportional to the degree of histogram, similar to that mentioned above.

Figure 9A:
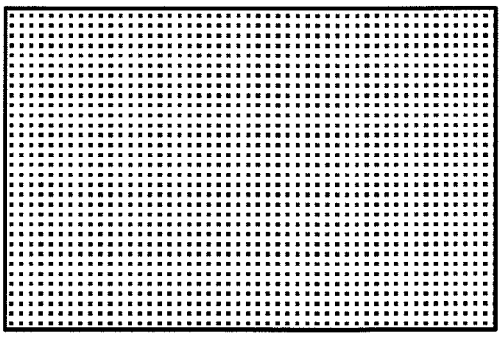
FIGS. 9(A) and 9(B) are views for showing examples of high averaged brightness (APL) displayed on the display device of the image processing apparatus mentioned above.
Figure 9B:
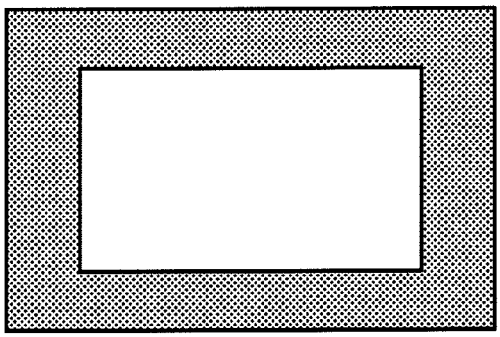

And, FIGS. 9(A) and 9(B) attached herewith show other examples, and in those examples, both are same of APL, i.e., the averaged brightness of the image obtained within the feature detector portion 12 mentioned above, but in the case of the high averaged brightness (High APL), differing from those examples shown in the above.

Thus, an image shown in FIG. 9(A) is a scene of being high in APL and also being high in the degree of histogram within the regions of the middle and the low gradations (MID and LOW). Comparing such scene to the matrix shown in FIG. 3 mentioned above, the averaged brightness (APL) is the high averaged brightness (High APL), and also the degree of high brightness (i.e., the degree of histogram) is about "Mid_HST", then it is within the region of "B3". However, for such the screen, since the image becomes dark as a whole if lowering the brightness of backlight, then it is preferable for the brightness of backlight, not to be lowered down.

On the other hand, an image shown in FIG. 9(B) is a scene of being high in APL, and in particular, being high in the degree of histogram within the high gradation region (HIGH) duel to much region of the white peak. Comparing this scene to the matrix shown in FIG. 3 mentioned above, this is within the region "C3" where the high brightness degree (i.e., the degree of histogram) is equal or greater than "High_HST". Further, in case of such screen, it is preferable to control the brightness, appropriately, by reducing the brightness of the backlight.

Figure 10:
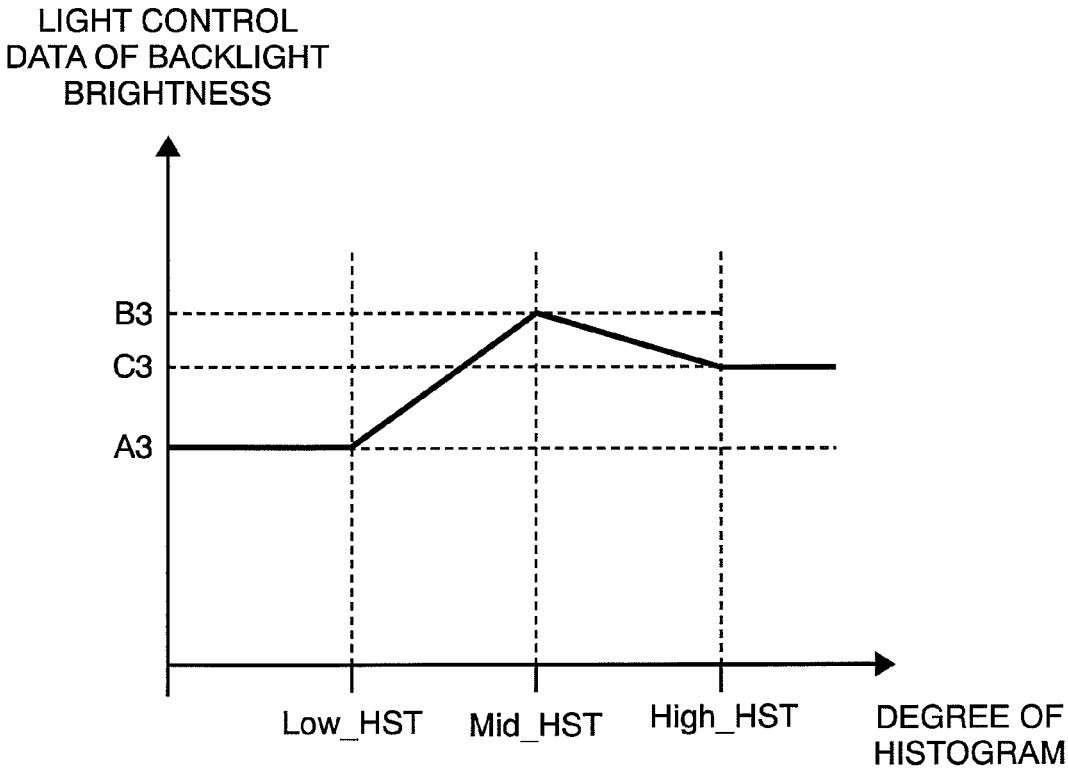
FIG. 10 is a view for showing an example of the degree of the brightness histogram and the backlight brightness suitable for the screen shown in FIGS. 9(A) and 9(B)

Then, in case of the screen shown in FIGS. 9(A) and 9(B) mentioned above, the control values "A3", "B3" and "C3" of the backlight brightness within the matrix shown in FIG. 3 mentioned above are set up, as is shown in FIG. 10 attached herewith; i.e., A3<B3<C3. With this, it is also possible to control the backlight brightness depending upon the degree of the brightness histogram, in case when the averaged brightness (APL) is at the high averaged brightness (High APL), in the similar manner, and thereby setting up the brightness, most suitably, depending on the image.

Further, the control values "A1" to "A3", "B1" to "B3", and "C1" to "C3" (in more details, the matrix shown in FIG. 3 mentioned above) of the backlight brightness, the details of which are explained in the above, may be set up in advance, to be stored within the memory, which builds up a part of the μ-computer 13, or an outer memory means (i.e., an external memory), etc., for example, and thereby, it is apparent to make possible of achieving the control of the backlight brightness, easily.

Within the embodiments explained in the above, by means of the μ-computer 13 shown in FIG. 1 mentioned above, analysis is made on the features on the distribution characteristics of each histogram, upon basis of the information relating to the APL and the brightness/color histogram inputted, and the video control signal produced upon basis of the result of that analysis is outputted to the video compensator portion 14, as was mentioned above; however, further according to the present invention, it is also possible to calculate that video control signal (i.e., characteristics of video input/output amplitude) depending on the backlight brightness (thus, the dim or light control signal) calculated in such manner as mentioned above (i.e., the control combining the backlight control and the image processing). However, the backlight brightness is at lowest when the dim or light control signal is "0", i.e., darkest, while "255" is at highest, i.e., brightest.

Figure 11A:
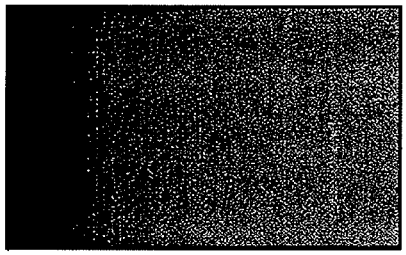
FIGS. 11(A) and 11(B) are views for showing an example of further other image displayed on the display device of the image processing apparatus mentioned above.
Figure 11B:
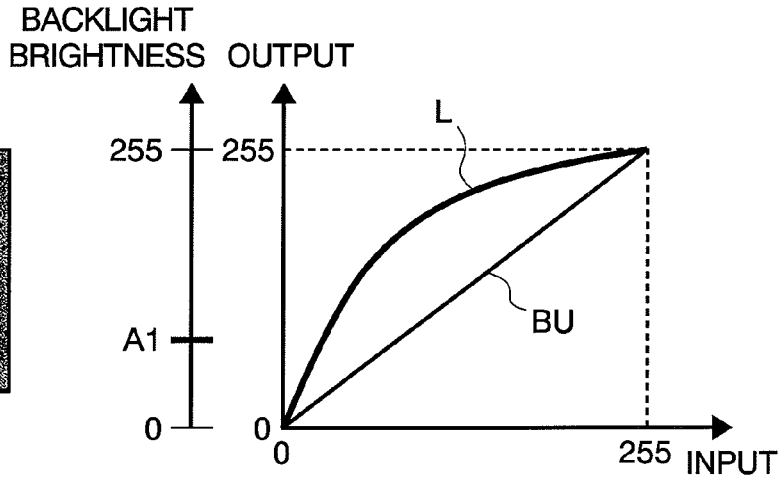

For example, the image shown in FIG. 11(A) is a gradation image made up by gathering low gradations (i.e., dark on the left-hand side and more lighter on the right-hand side, in the figure). Since this image is dark as a whole, the averaged brightness (APL) is low, and it is an image having no degree of the high gradation histogram. In such case, comparing to the matrix shown in FIG. 3 mentioned above, it fits to the region "A1", and normally, it is preferable to make a control to lower down the backlight brightness for tightening the black color. However, on the other hand, lowering down the backlight brightness also sometimes brings about a possibility that the gradation is crushed on the low brightness side. Then, in case of lowering the backlight brightness, a process is conducted for increasing the gradation, in particular, by increasing an inclination on the low brightness side (see the characteristic "BU" in the figure) with respect to the linear characteristic (the solid line "L" in the figure), on the characteristics of input/output amplitude of the video signal shown in FIG. 11(B). Thus, with this, it is possible to output a superior image, with tightening the black color by reducing the backlight, but not losing the contrast feeling in relation to other gradations.

Figure 12A:
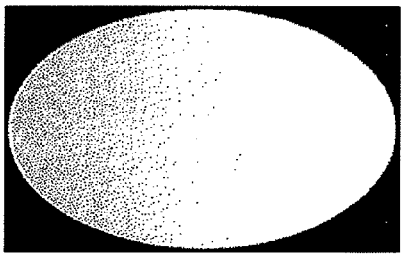
FIGS. 12(A) and 12(B) are views for showing an example of further other image displayed on the display device of the image processing apparatus mentioned above.
Figure 12B:
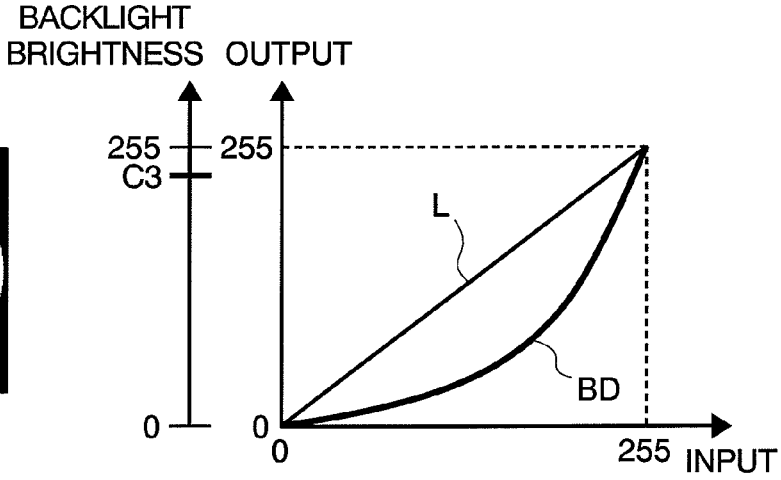

Additionally, as is shown in FIG. 12(A) attached herewith, with a gradation image of gathering the high gradation at a central portion thereof while the surrounding thereof is black, the averaged brightness (APL) thereof is high since the image is bright as a whole, and it is an image of being high in the degree of high gradation histogram thereof. In such case, comparing to the matrix shown in FIG. 3 mentioned above, it fits to the region "C3" thereof, and normally, it is preferable to control the backlight brightness, i.e., not lower down, or lower it, appropriately, for keeping the high brightness side to be bright. However, no reduction on the backlight may cause cases where the gradations on the low brightness side are floated up. Then, in case of not lowering the backlight brightness, as is shown in FIG. 12(B), a process is conducted for tightening the black color, in particular, by decreasing the inclination on the low brightness side (see the characteristic "BD" in the figure) with respect to the linear characteristic (the solid line L in the figure), on the characteristics of input/output amplitude of the video signal. With this, it is possible to output an image, being tightened on the gradation on the black side even when brightening it as a whole, and also bright on gradation of the high brightness and giving the contrast feeling, without reducing the backlight brightness.

In this manner, by changing the characteristics of input/output amplitude of the image depending on the backlight brightness, in addition to the control of the backlight brightness mentioned above, it is further possible to enable set up an image most suitably or appropriately depending on the features of the image. Thus, with the process mentioned above, it is possible to grasp the features of that image, in details thereof, so as to set up the backlight brightness responding to the features of that image, and for a viewer, it is possible to enjoy the image with an appropriate brightness. Further, since it controls the backlight brightness downwards, it also results into a reduction of consumption of electric power.

However, in the embodiments mentioned above, the explanation was made that detection is made on the brightness histogram thereof, as well as, the averaged brightness (APL) of the image signal inputted, in particular, within the feature detector portion 12 mentioned above. However, the present invention should not be restricted only to that For example, it is of course for the person skilled in the art, that detecting the histogram information in relation to the colors enables to analyze the image upon basis of that color histogram.

While we have shown and described several embodiments in accordance with our invention, it should be understood that disclosed embodiments are susceptible of changes and modifications without departing from the scope of the invention. Therefore, we do not intend to be bound by the details shown and described herein but intend to cover all such changes and modifications that fall within the ambit of the appended claims.

What is claimed is:

1. A liquid crystal display, comprising:

a liquid crystal display portion, which is configured to input a video signal to display an image thereon;

a backlight, which is provided on a rear side of said liquid crystal display portion, and is configured to illuminates said liquid crystal display portion from a rear surface thereof;

a backlight driver portion, which is configured to drive said backlight, and also to have a light control function for controlling a light intensity of the illuminating lights from said backlight;

a feature detector portion, which is configured to detect an averaged brightness of said video signal and also a histogram of brightness or a color, upon basis of said video signal inputted; and a light intensity control portion, which is configured to control the light intensity of the illuminating lights from said backlight, through the light control function of said backlight driver portion, upon basis of said histogram of brightness or color and also said averaged brightness of said video signal detected by said feature detector portion, wherein said light intensity control portion classifies said histogram of brightness into, at least, three stages, a low brightness region, a middle brightness region and a high brightness region, and classifies a level of said average brightness into, at least three stages, low average brightness, middle average brightness and high average brightness, and in a case that a level of said average brightness level detected by said feature detector portion is middle average brightness, and when a degree of said histogram of brightness on a high brightness region is higher than a first threshold value, said light intensity control portion decreases light intensity of said backlight, as a degree of said high brightness region increases.

2. The liquid crystal display, as described in claim 1, wherein said light intensity control sets said light intensity to a first value in a case when a degree of said histogram of brightness on a high brightness region is equal to or lower than said first threshold value, and sets to a second value, which is lower than said first value in a case when a degree of said histogram of brightness on a high brightness is equal to or higher than a second threshold value, which is higher than said first threshold value, and decreases light intensity of said backlight between said first value and second value, as a degree of said high brightness region increases, in a case when a degree of said histogram of brightness on a high brightness is higher than said first threshold value but lower than said second threshold value.

3. A liquid crystal display, comprising:

a liquid crystal display portion, which is configured to input a video signal to display an image thereon;

a backlight, which is provided on a rear side of said liquid crystal display portion, and is configured to illuminates said liquid crystal display portion from a rear surface thereof;

a backlight driver portion, which is configured to drive said backlight, and also to have a light control function for controlling of a light intensity of the illuminating lights from said backlight;

a feature detector portion, which is configured to detect an average brightness of said video signal and also a histogram of brightness or a color, upon basis of said video signal inputted; and a light intensity control portion, which is configured to control the light intensity of the illuminating lights from said backlight, through the light control function of said backlight driver portion, upon basis of said histogram of brightness and color and also said average brightness of said video signal detected by said feature detector portion, wherein said light intensity control portion classifies said histogram of brightness region, a middle brightness region and a high brightness region, and classifies a level of said average brightness into, at least, three stages, low average brightness, middle average brightness and high average brightness, and in a case that said average brightness level detected by said feature detector portion is middle average brightness, when a degree of said histogram of brightness on a high brightness region is higher than a first threshold value, said light intensity control portion increases light intensity of said backlight, as a degree of said high brightness region increases.

4. The liquid crystal display, as described in claim 3, wherein said light intensity control sets said light intensity to a first value in a case when a degree of said histogram of brightness on a high brightness region is equal to or lower than said first threshold value, and sets to a second value, which is higher than said first value in a case when a degree of said histogram of brightness on a high brightness is equal to or higher than a second threshold value, which is higher than said first threshold value, and increases light intensity of said backlight between said first value and second value, as a degree of said high brightness region increases, in a case when a degree of said histogram of brightness on a high brightness is higher than said first threshold value but lower than said second threshold value.

5. A liquid crystal display, comprising:

a liquid crystal display portion, which is configured to input a video signal to display an image thereon;

a backlight, which is provided on a rear side of said liquid crystal display portion, and is configured to illuminate said liquid crystal display portion from a rear surface thereof;

a backlight driver portion, which is configured to drive said backlight, and also to have a light control function for controlling of a light intensity of the illuminating lights from said backlight;

a feature detector portion, which is configured to detect an average brightness of said video signal and also a histogram of brightness or a color, upon basis of said video signal inputted; and a light intensity control portion, which is configured to control the light intensity of the illuminating lights from said backlight, through the light control function of said backlight driver portion, upon basis of said histogram of brightness and color and also said average brightness of said video signal detected by said feature detector portion, wherein said light intensity control portion classifies said histogram of brightness into, at least, three stages, a low brightness region, a middle brightness region and a high brightness region, and classifies a level of said average brightness into, at least, three stages, low average brightness, middle average brightness and high average brightness, and in a case that said average brightness level detected by said feature detector portion is low average brightness, and when a degree of said histogram of brightness on a high brightness region is higher than a first threshold value, said light intensity control portion increases light intensity of said backlight, as a degree of said high brightness region increases.

6. The liquid crystal display, as described in claim 5, wherein said light intensity control sets light intensity to a first value in a case when a degree of said histogram of brightness on a high brightness region is equal to or lower than said first threshold value, and sets to a second value, which is higher than said first value in a case when a degree of said histogram of brightness on a high brightness is equal to or higher than a second threshold value, which is higher than said first threshold value, and increases light intensity of said backlight between said first value and second value, as a degree of said high brightness region increases, in a case when a degree of said histogram of brightness on a high brightness is higher than said first threshold value but lower than said second threshold value.

7. The liquid crystal display, as described in claim 5, further comprising:

a video compensator portion, which is configured to have input/output amplitude characteristics to be controlled depending on a level of said average brightness and a detection result of said histogram of brightness, and output a video signal by changing amplitude of such a video signal inputted upon basis of the input/output amplitude characteristics, and wherein said video compensator portion is controlled to increase an inclination on a low brightness side of said input/output amplitude characteristics, in a case when a level of said detected average brightness is low average brightness and a degree of said histogram of brightness on a high brightness region is equal to or higher than said third threshold level.

8. The liquid crystal display, as described in claim 5, further comprising:

a video compensator portion, which is configured to have input/output amplitude characteristics to be controlled depending on a level of said average brightness and a detection result of said histogram of brightness, and output a video signal by changing amplitude of such a video signal inputted upon basis of the input/output amplitude characteristics, and wherein said video compensator portion is controlled to decrease an inclination on a low brightness side of said input/output amplitude characteristics, in a case when a level of said detected average brightness is low average brightness and a degree of said histogram of brightness on a high brightness region is equal to or higher than said third threshold level.

9. A liquid crystal display comprising:

a liquid crystal display portion, which is configured to input a video signal to display an image thereon;

a backlight, which is provided on a rear side of said liquid crystal display portion, and is configured to illuminates said liquid crystal display portion from a rear surface thereof;

a backlight driver portion, which is configured to drive said backlight, and also to have a light control function for controlling of a light intensity of the illuminating lights from said backlight;

a feature detector portion, which is configured to detect an average brightness of said video signal and also a histogram of brightness or a color, upon basis of said video signal inputted; and a light intensity control portion, which is configured to control the light intensity of the illuminating lights from said backlight, through the light control function of said backlight driver portion, upon basis of said histogram of brightness and color and also said average brightness of said video signal detected by said feature detector portion, wherein said light intensity control portion classifies said histogram of brightness into, at least, three stages, a low brightness region, a middle brightness region and a high brightness region, and classifies a level of said average brightness into, at least, three stages, low average brightness, middle average brightness and high average brightness, and in a case that said average brightness level detected by said feature detector portion is high average brightness, when a degree of said histogram of brightness on a high brightness region is within between a first threshold value and a second threshold value, which is higher than the first threshold value, said light intensity control portion increases light intensity of said backlight between a first value and a second value, which is higher than the first value, as a degree of said high brightness region increases, and when a degree of a high brightness region is within between said second threshold value and a third threshold value, which is higher than the second threshold value, said light intensity control portion decrease light intensity of said backlight between said second value and a third value, which is lower than the second value but higher than the first value, as a degree of said high brightness region increases.

10. The liquid crystal display, as described in claim 9, wherein said light intensity control portion sets said light intensity to said first value in a case when a degree of said high brightness region is equal to or lower than said first threshold value, and sets to said third value in a case when a degree of said high brightness region is equal to or higher than said third threshold value.

* * * * *